United States Patent [19]

Caruso et al.

[11] 4,076,631

[45] Feb. 28, 1978

[54] ANTISOILING AND ANTISTATIC TEXTILE TREATING COMPOSITION

[75] Inventors: Michael G. Caruso, Jamestown, N.C.; Réne A. Eckert, Simpsonville, S.C.

[73] Assignee: Chas. S. Tanner Co., Greenville, S.C.

[21] Appl. No.: 692,687

[22] Filed: Jun. 14, 1976

[51] Int. Cl.[2] ..... D06M 13/34

[52] U.S. Cl. ..... 252/8.8; 106/2; 428/96

[58] Field of Search ..... 252/8.8, 8.9; 428/96; 106/2; 8/76; 260/29.6

[56] References Cited

U.S. PATENT DOCUMENTS

| | | | |
|---|---|---|---|
| 3,835,148 | 9/1974 | Oxe et al. | 8/76 |
| 3,923,715 | 12/1975 | Dettre et al. | 260/29.6 R |
| 3,935,150 | 1/1976 | Oxe et al. | 106/2 |
| 3,940,359 | 2/1976 | Chambers | 260/29.6 MN |
| 3,983,061 | 9/1976 | Oxe et al. | 8/76 |

*Primary Examiner*—William E. Schulz
*Attorney, Agent, or Firm*—Dressler, Goldsmith, Clement, Gordon & Shore, Ltd.

[57] ABSTRACT

A textile treating composition adapted to provide a relatively permanent antistatic and dirt repellent finish and consisting essentially of an aqueous dispersion of:

1. about 10% to about 20% of an antistatic agent comprising a compound of the formula

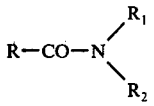

in which R is an alkyl radical having 14 to 20 carbon atoms, $R_1$ and $R_2$ are, each independently, alkyl, hydroxy alkyl, alkyl substituted by carboxylic and/or sulphonic acid groups, aminoalkoxyalkyl or aminoalkyl wherein the amino group is unsubstituted or substituted by hydroxyalkyl, cyanoalkylaminoalkyl or by the group R—CO— or —R—CO—NH-alkoxyalkyl wherein R is alkyl having 14 to 20 carbon atoms, or one of $R_1$ and $R_2$ is hydrogen;

2. about 3% to about 35% of an aqueous dispersion of hard particles having a weight average particle diameter of less than about 2 microns;

3. about 1% to about 6% of a fluorine-free inorganic or organic monobasic or polybasic acid;

4. 0% to about 5% of an antimicrobic agent; and 5. about 1% to about 35% of a fluorocarbon agent which provides a low free energy surface.

5 Claims, No Drawings

ANTISOILING AND ANTISTATIC TEXTILE TREATING COMPOSITION

The present invention relates to aqueous dispersion textile treating compositions particularly adapted for the treatment of carpets to provide a relatively permanent antistatic and dirt repellent finish.

The effort to provide synthetic fibers with relatively permanent antistatic and dirt repellant surfaces has been a continuing one. Particular reference is made to U.S. Pat. Nos. 3,835,148 and 3,935,150 in which one or more antistatic agents having the formula

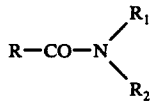

are combined with an acid and a polystyrene dispersion to provide an aqueous dispersion for the treatment of synthetic fibers, particularly pile fabrics such as polyamide carpets.

Another effort to handle the soiling of textile fibers is illustrated by U.S. Pat. No. 3,923,715 where perfluoroalkyl esters of a carboxylic acid are employed together with a hard nonfluorinated vinyl polymer such as polystyrene or polymethyl methacrylate. In this disclosure, the volatility of the perfluoroalkyl ester contributes resistance to flame propagation which is impaired by the presence of the usual fluorocarbon polymer.

U.S. Pat. No. 3,940,359 describes another effort to enhance soil repellancy, this time by combining specified proportions of tiny particles of hydrous metal oxides, illustrated by silica, alumina, or aluminum-modified silica, with polymer particles containing $—CF_3$ groups, and which are polymers of certain fluorinated alcohols with either acrylic or methacrylic acid.

Despite these many efforts to enhance the properties of synthetic fibers, the maximization of antistatic and dirt repellency characteristics remains a significant objective, and it is this objective which is the primary concern of this invention.

In accordance with this invention, a textile treating composition adapted to provide a relatively permanent antistatic and dirt repellent finish consists essentially of an aqueous dispersion of:

1. about 10% to about 20% of an antistatic agent comprising a compound of the formula

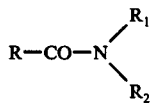

in which R is an alkyl radical having 14 to 20 carbon atoms, $R_1$ and $R_2$ are, each independently, alkyl, hydroxy alkyl, alkyl substituted by carboxylic and/or sulphonic acid groups, aminoalkoxyalkyl or aminoalkyl wherein the amino group is unsubstituted or substituted by hydroxyalkyl, cyanoalkylaminoalkyl or by the group R—CO— or —R—CO—NH-alkoxyalkyl wherein R is alkyl having 14 to 20 carbon atoms, preferably 16–18 carbon atoms, or one of $R_1$ and $R_2$ is hydrogen;

2. about 3% to about 35% of an aqueous dispersion of hard particles having a weight average particle size of less than about 2 microns;

3. about 1% to about 6% of a fluorine-free inorganic or organic monobasic or polybasic acid;

4. 0% to about 5% of an antimicrobic agent; and 5. about 1% to about 35% of a fluorocarbon agent which provides a low free energy surface, preferably from 5% to 20%.

Throughout this application, and in the appended claims, all proportions are by weight unless otherwise specified.

The antistatic agents which are uniquely adapted to provide a synergistic improvement in soil resistance have been defined previously, and are themselves known, being fully described in U.S. Pat. Nos. 3,835,148 and 3,935,150, the disclosures of which are hereby incorporated by reference. It is preferred to employ a mixture of antistatic agents, one of which has the formula:

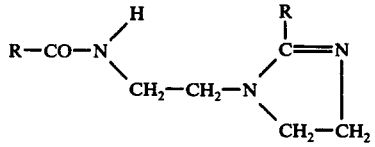

and the other of which has the formula:

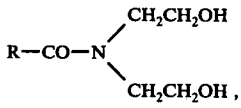

R being alkyl of 14 to 20 carbon atoms in both formulas. This invention will be illustrated by a mixture of the two agents noted above in which R is the alkyl group $C_{17}H_{35}$.

The antistatic agents are preferably used together with a nonionic surfactant which is preferably an ethylene oxide adduct of a hydrophobic organic compound containing from 5–100 moles of ethylene oxide (preferably 6–60 moles) per mole of hydrophobe. The preferred hydrophobes are $C_{14}$–$C_{20}$ alkanols and alkyl phenols containing 8 to 12 carbon atoms in the alkyl group. Nonyl phenol adducted with 9 moles of ethylene oxide per mole of the phenol and octadecyl alcohol adducted with 18 moles of ethylene oxide per mole of the alcohol will be used as illustrative of this known class of surfactants.

The hard particles used herein should have a weight average particle diameter of less than about 2 microns, preferably from about 0.05 micron to about 1 micron, and these particles may be organic or inorganic. The inorganic particles are harder than the organic ones, so the lower limiting hardness can be approximately defined as harder than a thermoplastic linear addition polymer having a $T_g$ (Glass transition temperature) of about 30° C. Polystyrene particles as described in U.S. Pat. No. 3,935,150 may be used, or polymethyl methacrylate as noted in U.S. Pat. No. 3,923,715. Colloidal particles of hydrous metal oxides such as silica, alumina or aluminum-modified silica as described in U.S. Pat. No. 3,940,359 are also useful.

Numerous acids may be used as described in U.S. Pat. No. 3,935,150, o-phosphoric acid being preferred and used herein as illustrative. Any acid which will protonate the antistatic agent is broadly useful.

The other materials which may be present are antimicrobic agents and agents which promote solubility as discussed in said U.S. Pat. No. 3,935,150.

Fluorocarbon agents which provide low free energy surfaces are themselves well known and are of widely diverse type.

The fluorocarbons may be monomeric or polymeric and preferably include a proportion of $—CF_3$ groups, since these are somewhat more effective than $=CF_2$ groups. The monomeric fluorocarbons are illustrated by perfluoroalkyl esters of carboxylic acids as described in U.S. Pat. No. 3,923,715. The perfluoroalkylcarboxylic acid esters described in U.S. Pat. No. 3,914,225 are quite useful herein, as are the perfluoroalkylthioether alcohols, esters thereof and polymers described in U.S. Pat. No. 3,884,879. The same is true for the monomers and polymers of amides or imides of fluorinated alkylamines with maleic or similar unsaturated dibasic acids as described in U.S. Pat. No. 3,821,299. Urethanes as noted in U.S. Pat. No. 3,896,035 are also useful.

Among the polymeric fluorocarbons, polyvinylidene fluoride is useful, but it is preferred to employ polymers containing the $—CF_3$ group as is found in homopolymers and copolymers of monoethylenic compound primarily constituted by esters of acrylic or methacrylic acid with a fluorinated alcohol containing 2 to 12 carbon atoms and containing from 1 to 3 $—CF_3$ groups as described in U.S. Pat. No. 3,940,359.

Numerous commercial fluorocarbons are available to provide the low energy surface. Thus, 3M provides Scotchgard FC 376, FC 378 and FC 380; DuPont provides Zepel C, and Zepel 4243.

From the standpoint of chemical structure, some useful fluorocarbons have the following structures:

1. $R_fSO_2\overset{\overset{R_3}{|}}{N}R_4O\overset{\overset{O}{\|}}{C}CR_5{=}CH_2$ 2. $R_f(CH_2)_nO\overset{\overset{O}{\|}}{C}CR_5{=}CH_2$ 3. $R_f\overset{\overset{OR_3}{\|\,|}}{C}NR_4O\overset{\overset{O}{\|}}{C}CR_5{=}CH_2$ 4. $R_fCH_2\overset{\overset{OH}{|}}{C}HCH_2O\overset{\overset{O}{\|}}{C}CR_5{=}CH_2$ 5. $R_fCH_2\overset{\overset{O}{\|}}{C}OCR_5{=}CH_2$ where $R_f$ is a perfluoroalkyl group with 3-21 carbon atoms, $R_3$ is $C_1$-$C_{10}$ alkyl, $R_4$ is $C_1$-$C_{12}$ alkylene, and $R_5$ is hydrogen or methyl.

The invention is illustrated in the following example and evaluation thereof.

EXAMPLE 160 g of deionized water has added thereto 1.86 g of an aliphatic nonionic surfactant having the formula $C_{18}H_{17}O(CH_2CH_2O)_{18}H$ and 80 g of a fatty acid amide of the formula:

$$C_{17}H_{35}—CON\begin{matrix}CH_2CH_2OH\\CH_2CH_2OH\end{matrix}.$$

This mixture is slowly heated with stirring to 60° C. to form a paste and 0.67 g nonionic surfactant constituted by nonyl phenol adducted with 9 moles of ethylene oxide per mole of phenol. 7.25 g of 80% acetic acid is added and stirring is continued at 60° C. for 30 minutes. The mixture is then cooled to 30° C. and 42 g of 80% o-phosphoric acid dissolved in 143.22 ml. of water are stirred in to form a viscous paste.

10 g of an antimicrobial having the formula:

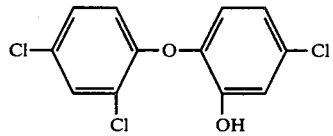

are melted at 80° C. with 15 g of the above described aliphatic nonionic surfactant and 6 g of oleic acid and, after cooling to 30° C., 69 g of deionized water are added to form a solution which is added to the above described viscous paste to thin the same.

53.5 g of compound having the formula:

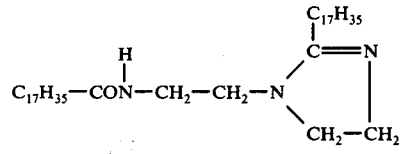

are dissolved in 251.88 g of deionized water with the aid of 8.65 g of 80% acetic acid and mixed with 150 g of a 40% polystyrene aqueous emulsion, the polystyrene having an average particle size of about 0.13 micron (the method shown in Example 1 of U.S. Pat. No. 3,544,501 is used to form the polystyrene emulsion).

This mixture containing the polystyrene emulsion is slowly added with stirring to the freshly prepared thinned paste previously made to provide an aqueous dispersion which may be used directly for the treatment of carpets to provide an antistatic character to the carpet and resistance to dry soil, but not to oily dirt.

More particularly, application of the above aqueous dispersion at 2% solids application level to a polyamide carpet (Nylon 6) having a pile weight of 800 g/m$^2$ and dyed blue with the dye specified in Example 1 of U.S. Pat. No. 3,835,148 exhibits very good dry soil resistance and an excellent capacity to discharge static electricity, but the resistance to oily dirt is 0 on a scale of 0-6 where 0 is poor and 6 is excellent.

Using the commercially available fluorocarbon, Scotchgard FC 376 (at 35.3% solids containing 27.6% fluorine) at an application level of 0.95% in the same test, the dry soil resistance was also very good, but the antistatic quality was poor while the resistance to oily dirt was quite good (5-6). Substituting the commercially available fluorocarbon, Zepel C, at 1.0% application level in the same test provided substantially the same performance.

In an effort to improve the antistatic quality, 0.45% of a commercially available antistatic agent, Scotchgard Antistat, was added to the 0.95% of Scotchgard FC 376, and the static resistance increased from poor to good, but the dry soil resistance fell off from very good to good.

The proportion of Scotchgard FC 376 was then reduced from 0.95% to 0.55%, and 1.55% of the aqueous dispersion product of this Example was added. Dry soil resistance was now excellent which is better than either Scotchgard FC 376 product or the product of this Example could provide alone; static resistance was very good, and the resistance to oily dirt was 5 on the said scale of 0–6. These same outstanding combination results are obtained using 0.55% of Zepel C in place of the 0.55% of Scotchgard FC 376.

The invention is defined in the claims which follow.

We claim:

1. A textile treating composition adapted to provide a relatively permanent antistatic and dirt repellent finish and consisting essentially of a nonionic surfactant-containing aqueous dispersion of:

1. about 10% to about 20% of an antistatic agent comprising a mixture of

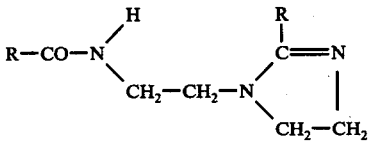

and

-continued

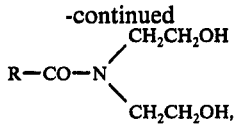

R being alkyl of 14 to 20 carbon atoms in both formulas 2. about 3% to about 35% of an aqueous dispersion of hard particles having a weight average particle diameter of from about 0.05 micron to about 1 micron;
3. about 1% to about 6% of a fluorine-free inorganic or organic monobasic or polybasic acid;
4. 0% to about 5% of an antimicrobic agent; and
5. about 1% to about 35% of a fluorocarbon agent which provides a low free energy surface, said fluorocarbon being a polymer containing the $—CF_3$ group.

2. A textile treating composition as recited in claim 1 in which R is the alkyl group $C_{17}H_{35}$.

3. A textile treating composition as recited in claim 1 in which said acid comprises o-phosphoric acid.

4. A textile treating composition as recited in claim 1 in which said polymer containing the $—CF_3$ group is formed by the addition polymerization of a perfluoroalkyl alcohol ester of a monoethylenically unsaturated carboxylic acid.

5. A textile treating composition as recited in claim 1 in which said fluorocarbon agent is used in an amount of from 5% to 20%.

* * * * *